United States Patent [19]

Bergandy

[11] 4,405,061

[45] Sep. 20, 1983

[54] FILLING MACHINE

[75] Inventor: Wieslaw Bergandy, Arnold, Md.

[73] Assignee: National Instrument Co., Inc., Baltimore, Md.

[21] Appl. No.: 335,244

[22] Filed: Dec. 28, 1981

Related U.S. Application Data

[63] Continuation-in-part of Ser. No. 293,859, Aug. 18, 1981, abandoned.

[51] Int. Cl.[3] ..... B67D 5/30

[52] U.S. Cl. ..... 222/21; 222/67; 222/148; 222/439; 222/444

[58] Field of Search ..... 222/64, 66, 67, 69, 222/148, 250, 389, 438, 439, 442, 444, 451, 453, 14, 21, 434, 450; 137/102, 107, 209, 240; 138/31

[56] References Cited

U.S. PATENT DOCUMENTS

| | | | |
|---|---|---|---|
| 1,605,133 | 11/1926 | Moroney . | |
| 1,825,039 | 9/1931 | Aspden . | |
| 2,472,389 | 6/1949 | Stoeser . | |
| 2,506,240 | 5/1950 | Sekkel | 222/21 |
| 2,565,045 | 8/1951 | Ray | 222/444 X |
| 2,783,920 | 3/1957 | Negoro | 222/444 X |
| 2,961,880 | 11/1960 | Griswold | 222/444 X |
| 2,978,149 | 1/1961 | Rosen | 222/318 |
| 3,134,506 | 5/1964 | Bayer . | |
| 3,194,434 | 7/1965 | Evanson . | |
| 3,254,805 | 6/1966 | Barger | 222/444 X |
| 3,439,835 | 4/1969 | Reid . | |
| 3,693,640 | 9/1972 | Wettlen . | |
| 3,834,586 | 9/1974 | Wilhelmson | 222/309 X |

*Primary Examiner*—Joseph J. Rolla
*Assistant Examiner*—Kevin P. Shaver
*Attorney, Agent, or Firm*—Antonelli, Terry & Wands

[57] ABSTRACT

A filling machine for supplying predetermined quantities of liquid is disclosed. The filling machine comprises a measuring chamber, a float positioned with clearance in the chamber and adapted to move up and down in at least a portion of the chamber with the level of liquid in the chamber, an abutment positioned in the chamber above the float for limiting the upper movement of the float in the chamber, and a seal adjacent the abutment for sealing against the chamber, the seal being arranged such that it can be moved into and out of sealing engagement with the chamber without disassembly of the filling machine thereby facilitating cleaning of the machine.

21 Claims, 9 Drawing Figures

FILLING MACHINE

This application is a continuation-in-part of application Ser. No. 293,859 filed Aug. 18, 1981, now abandoned.

The present invention relates to a filling machine for supplying predetermined quantities of liquid to containers, for example. In particular, the invention relates to an improved filling machine which reduces problems of contamination when liquids which must be of high purity are measured and supplied and which permits the entire measuring chamber of the filling machine to be cleaned without disassembly or extensive special adjustment of the components of the machine.

Contamination of the liquid being measured and supplied is a problem associated with the use of known filling machines. This problem is of particular concern where the filling machines are used in dispensing materials which must be of high purity, such as pharmaceutical drugs and medicines. When several such materials must be successively dispensed from the same filling machine, the filling machine must be cleaned or sterilized after each of the respective materials is dispensed to avoid contamination.

Many known filling machines for dispensing measured amounts of liquid employ a piston within a measuring cylinder for discharging liquid from the cylinder. During the discharge stroke, the pistons are typically driven by fluid pressure or a piston rod. Examples of such known devices are shown in U.S. Pat. Nos. 2,978,149 and 3,439,835. In these known filling machines, a seal in the form of an O-ring is provided between the piston and the cylinder to prevent fluids from bypassing the piston during its operation. While such known filling machines are satisfactory for dispensing many different liquids, these machines may be problematical where the materials to be dispensed must be of high purity, such as pharmaceutical drugs and medicines. In this latter case, problems with contamination may occur because of the presence of crevices about the O-ring seals which tend to trap liquid. Further, when several different materials of high purity must be successively dispensed into containers from the same filling machine, the O-ring seals about the piston do not permit through-cleaning of the entire system without disassembly. In an attempt to avoid this last-mentioned problem, in one prior art filling machine, U.S. Pat. No. 3,693,640, a widened portion is provided at one end of the cylinder so that when the piston is moved into the widened area, a cleaning agent can flow around the peripheral surface of the piston. However, in the case where an O-ring seal is provided about the piston, material may remain trapped in crevices adjacent the O-ring even after such a through-cleaning.

An object of the present invention is to provide a filling machine for supplying predetermined quantities of liquid wherein the aforementioned problems associated with known filling machines are avoided.

This and other objects of the present invention are attained by providing a filling machine for supplying predetermined quantities of liquid comprising measuring chamber means, float means positioned with clearance in said chamber means and adapted to move up and down in at least a portion of said chamber means with the level of liquid in said chamber means, abutment means positioned in said chamber means above said float means for limiting the upward movement of said float means in said chamber means, and seal means adjacent said abutment means for sealing against said chamber means, the seal means being arranged such that it can be moved into and out of sealing engagement with the chamber means without disassembly of the filling machine thereby facilitating cleaning of the machine.

Float-controlled filling machines are, per se, known, for example, see U.S. Pat. No. 3,194,434. However, in this known filling machine the volume of the measuring chamber is fixed, and it is necessary to employ additional control circuitry such as the use of a switching device actuated by the breaking of a beam of light by the float to control the volume dispensed.

In one known measuring and dispensing apparatus, U.S. Pat. No. 1,815,039, a float with limited movement is employed in combination with a movable disk or partition spanning the cylindrical bore of the measuring chamber. By adjusting the position of the partition in the chamber the volume of liquid dispensed in a single operation of the apparatus may be varied. The partition is provided with water-tight packing between its periphery and the wall of the measuring chamber. This apparatus is used for measuring and dispensing water for concrete mixers. However, where liquids of high purity must be dispensed, the device would be prone to the same problems discussed above with respect to other known devices in that material could be trapped in and around the seal or packing between the partition and the chamber wall and in that this packing would prevent a complete through-cleaning or sterilizing of the system.

In contrast, according to the present invention, a seal means is provided which can be moved into and out of sealing engagement with the chamber without disassembly of the filling machine thereby facilitating cleaning of the machine. The seal means preferably comprises an elastomeric member. The float means is configured to act as a valve at least at the upper end of its travel in the measuring chamber means such that the float means cooperates with the seal means and the abutment means to effectively close the upper end of the measuring chamber means to prevent any further increase in the level of liquid in the chamber means.

According to a further feature of the invention the seal means is arranged such that at least the outer edge portion of the seal means extends downwardly and outwardly at least when the seal means is out of sealing engagement with the chamber means so that the seal means is self-draining.

In a first, preferred embodiment of the invention the seal means is carried by the abutment means and seals against the chamber means in response to the upward movement of the float means. In particular, in this embodiment the seal means is secured at a radially inner portion thereof against a first downwardly and outwardly extending surface of the abutment means, a radially outer portion of the seal means being spaced from a second downwardly and outwardly extending surface of the abutment means. The float means contacts the radially outer portion of the seal means during its upward movement and moves the outer portion into sealing engagement with the chamber means and the second surface of the abutment means. The first and second surfaces of the abutment means form and obtuse angle with one another.

The filling machine according to a second disclosed embodiment of the invention comprises an adjustable support means for supporting the seal means adjacent the abutment means. The support means is adjustable between a first position where the seal means is supported so that it is in sealing engagement with the chamber means and a second position where the seal means is supported so that it is out of sealing engagement with the chamber means. The adjustable support means extends through a passage formed in the abutment means and to a location outside of the chamber means so that the seal means can be moved into and out of engagement with the chamber means without disassembling the filling machine.

Additional features of the invention include the provision of means for adjusting the position of the abutment means and the measuring chamber means to vary the volume of liquid supplied by the filler machine. When valving at both ends of the chamber means is desired, the float means may be configured to act as a valve at both ends of its travel in the chamber means. In this case the upper and lower surfaces of the float means are both convex.

Another arrangement according to the invention includes an additional float means in the bottom of the chamber means. The additional float means is configured to act as a valve at the lower end of its travel in the measuring chamber means to close the lower end of the measuring chamber means. In this form of the invention means are provided for limiting the downward movement of the float means in the chamber means and for limiting the upward movement of the additional float means in the chamber means. The means for limiting such movement include, according to one form of the invention, a stop screen positioned across the chamber means. In another form of the invention the means limiting such movement includes a link suspension means extending between the float means and the abutment means or the bottom of the chamber means.

These and other objects, features and advantages of the present invention will become more apparent from the following description when taken in connection with the accompanying drawings which show, for purposes of illustration only, several embodiments in accordance with the invention, and wherein.

Figure 8:
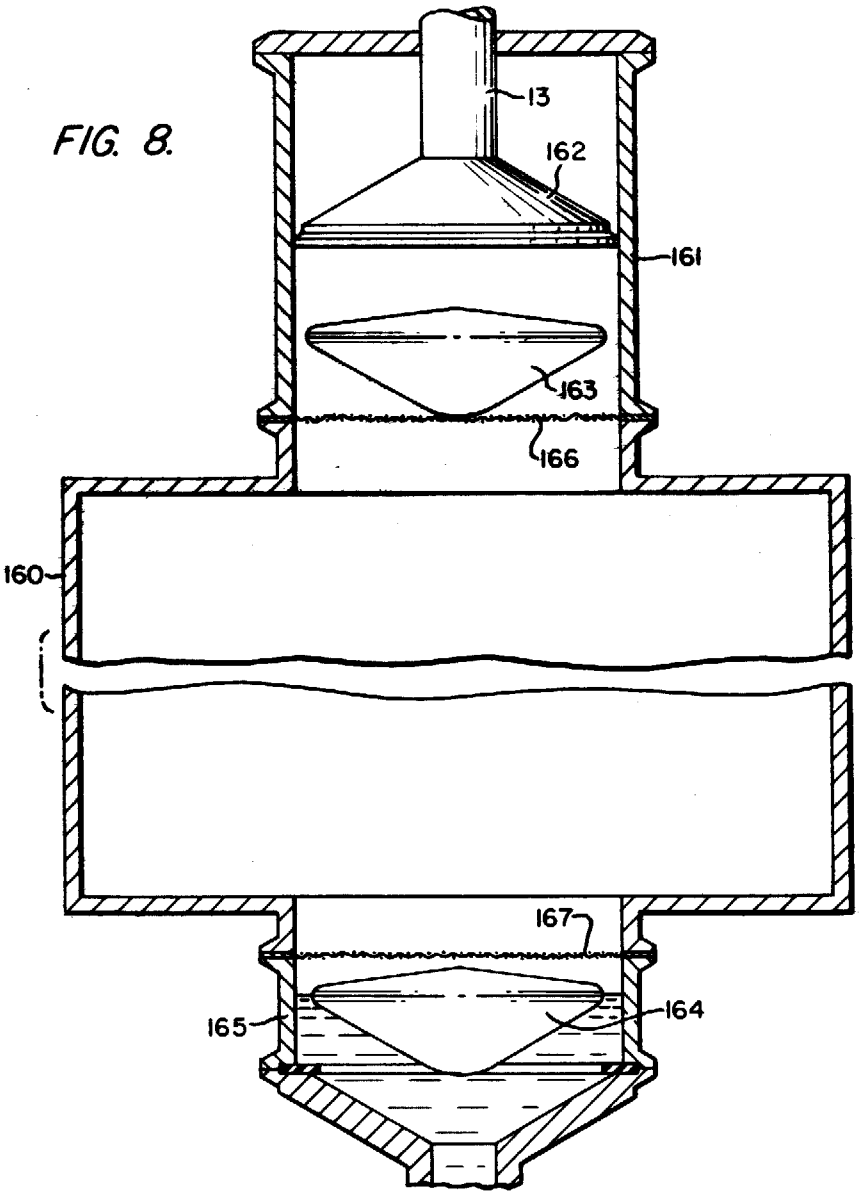
Figure 7:
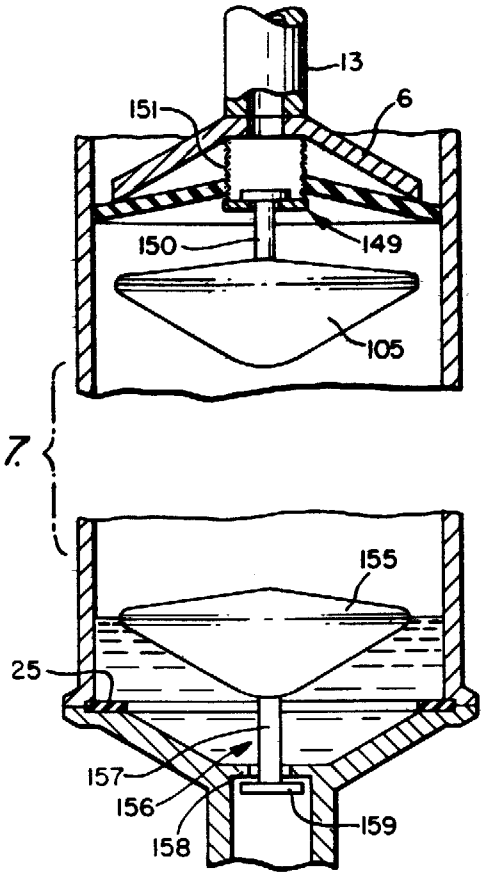

FIG. 7 is a schematic side view, partially in cross section, of another form of the filling machine of the invention wherein separate floats are provided at the top and bottom of the measuring chamber for respective valving of the ends of the chamber; and FIG. 8 is a schematic side view, partially in cross section, of an additional form of the filling machine of the invention wherein separate floats are provided at the top and bottom of the measuring chamber for respective valving of the ends of the chamber and wherein a removable main chamber is provided to permit substitution of another main chamber of different volume so as to vary the volume of liquid supplied by the filling machine.

Referring now to the drawings wherein like reference numerals are used throughout the various views to designate like parts, a filling machine 1 for supplying predetermined quantities of liquid is shown. The machine may be used for filling containers 2 with a predetermined amount of a liquid product. The filling machine as shown in FIGS. 1–4B comprises a filling unit 3 including a measuring chamber in the form of a cylinder 4, a float 5 positioned with clearance in the cylinder and adapted to move up and down in the cylinder with the level of liquid in the cylinder, an abutment 6 positioned with clearance in the cylinder above the float 5 for limiting the upward movement of the float in the cylinder, and a seal 7 which is arranged such that it can be moved into and out of sealing engagement with the measuring chamber without sealing against the cylinder disassembly of the filling machine thereby facilitating cleaning of the machine.

Figures 1, 2:
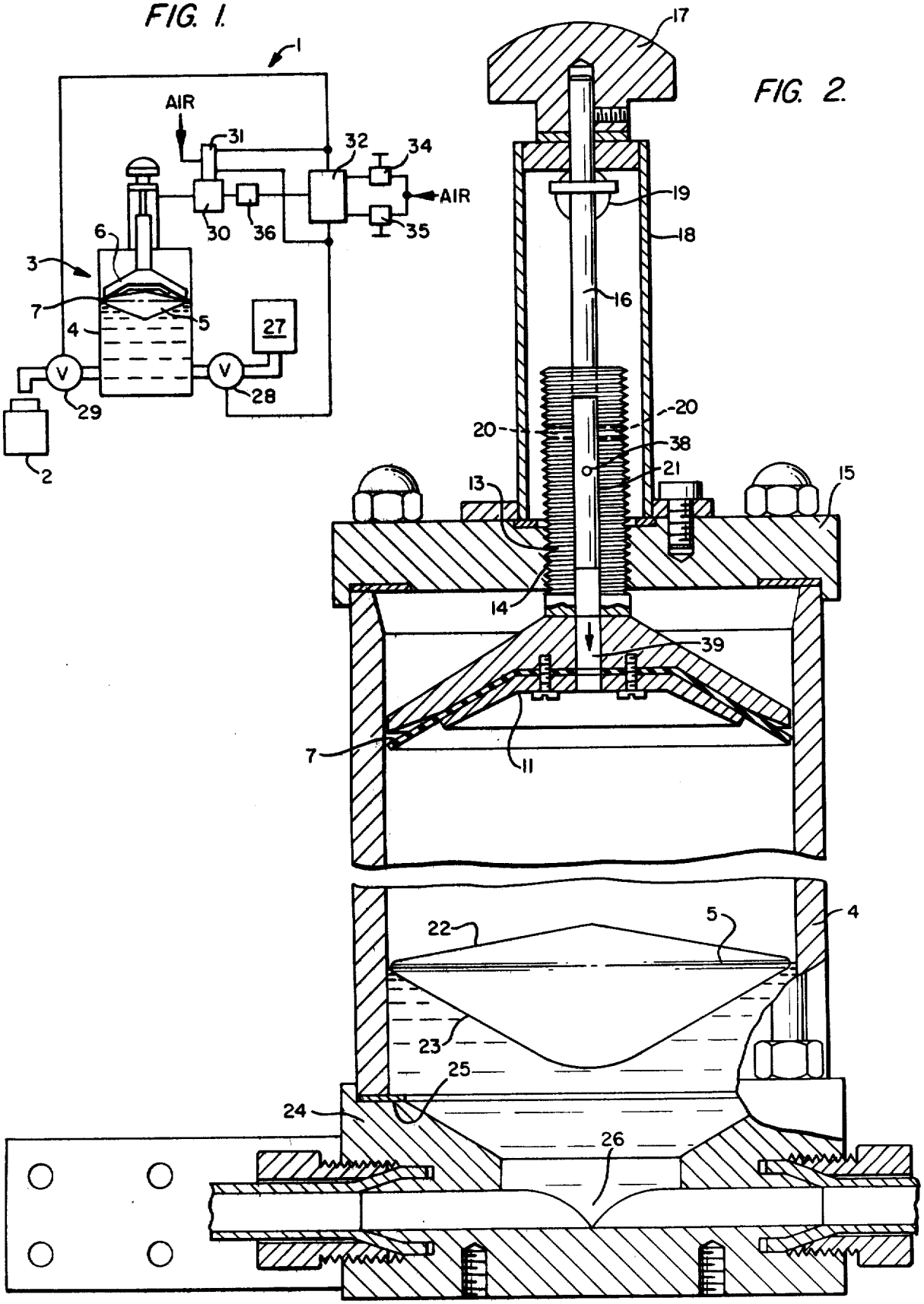
FIG. 1 is a schematic side view of a filling machine according to one embodiment of the invention.
FIG. 2 is a partial cross-sectional view of the filling machine showing FIG. 1 illustrating the arrangement of the measuring chamber with float, abutment and seal therein.
Figure 3:
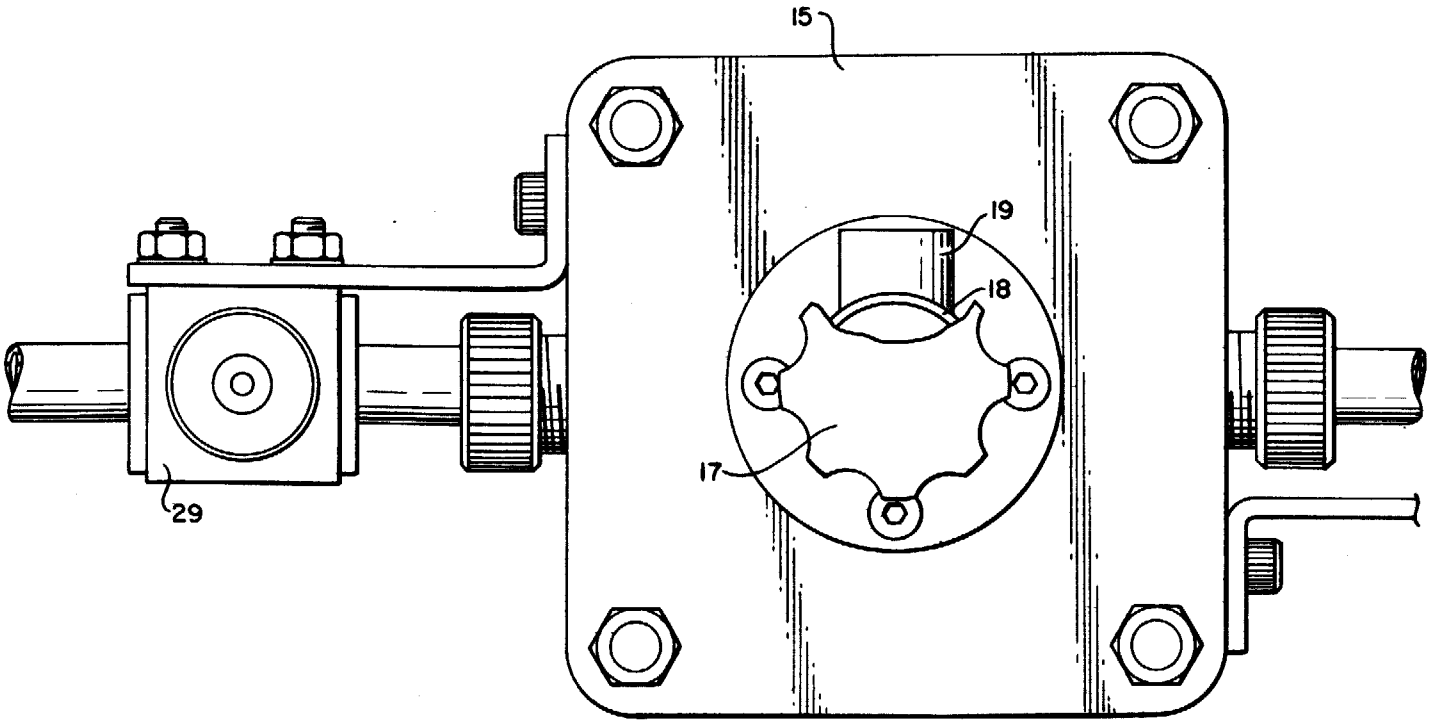
FIG. 3 is a top view of the measuring chamber arrangement illustrated in FIG. 2.
Figure 4A:
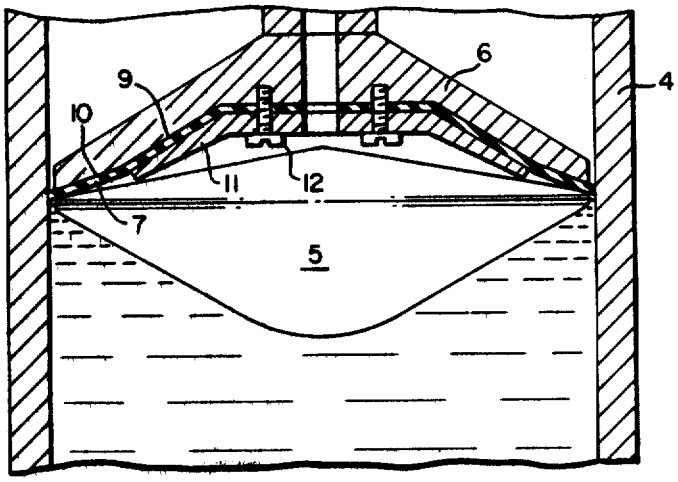
FIG. 4A is a schematic side view, partially in cross section, of the measuring chamber of FIG. 2, particularly illustrating the biased position of the elastomeric seal.
Figure 4B:
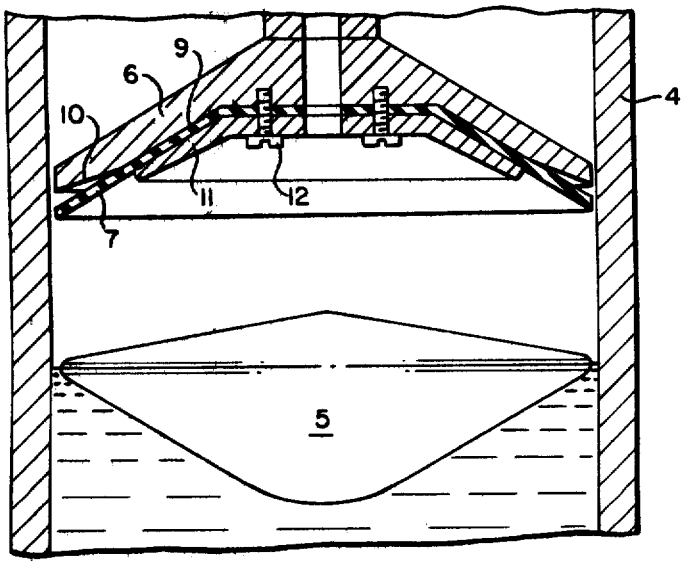
FIG. 4B is a schematic side view, partially in cross section, of the measuring chamber of FIG. 2, particularly illustrating the normal position of the elastomeric seal.

The seal 7 shown in FIGS. 2, 4A and 4B is an annular elastomeric member which is carried by the abutment 6 and seals against the cylinder of the measuring chamber and the float in response to the upward movement of the float. In particular, the seal 7 is secured at a radially inner portion thereof against a first downwardly and outwardly extending surface 9 of the abutment by means of a clamping plate 11 which is fastened to the abutment 6 by means of bolts 12. A radially outer proportion of the seal 7 is spaced from a second downwardly and outwardly extending surface 10 of the abutment.

The first and second surfaces 9 and 10 of the abutment form an obtuse angle with one another. The float 5 contacts the radially outer portion of the seal 7 during its upward movement and moves this outer portion into sealing engagement with the cylinder and the second surface 10 of the abutment. Because the seal 7 is elastomeric, when the float 5 moves away from the abutment 6, the radially outer portion of the seal returns to its normal position as shown in FIG. 4B. In this position, the seal is out of contact with the cylinder wall so that during cleaning or sterilizing, for example, steam can readily pass the abutment to clean the entire length of the cylinder without adjustment of the abutment. When the seal 7 is contacted by the upper peripheral portion of the float 5, the radially outer portion of the seal pivots about the point A at the intersection of the first and second downwardly and outwardly extending surfaces 9 and 10 so that the outer edge of the seal moves into sealing engagement with the cylinder as shown in FIG. 4A. In this position, the float 5, which is in sealing engagement with the seal 7, and the seal 7 effectively close the upper end of the cylinder adjacent the abutment to prevent any further increase in the level of liquid in the cylinder. Thus, the volume of liquid which may be introduced into the cylinder is determined by the position of the abutment 6 within the cylinder.

The seal 7 is formed of an elastomeric such as silicon rubber, Viton, etc. The specific material chosen depends on the solution which is to be dispensed. The float 5 is preferably made of a plastic material and may be a hollow plastic member. For accurate metering, the weight of the float should be selected in accordance with the specific gravity of the liquid dispensed so that the float will float on the surface of the liquid to be dispensed but be submerged to the outer edge of the float in said liquid. The width of the float should be less than that of the cylinder 4. For example, with a three inch diameter cylinder, a float which is $2\frac{7}{8}$ inches in diameter may be used.

For adjusting the position of the abutment 6 and, accordingly, the volume of the measuring cylinder beneath the abutment, a threaded sleeve 13 is provided at the top center of the abutment. The threaded sleeve is received in a threaded bore 14 provided in a top end plate 15 on the cylinder. A rod 16 is nonrotatably, but longitudinally slidably, connected to the sleeve 13 at its lower end. In particular, the lower end of the rod 16 is received in a slot 21 which traverses the entire width of the sleeve 13. A pin 38 is mounted on the rod 16 at right angles thereto. The pin 38 cooperates with the side walls of the slot 21 in sleeve 13 to prevent relative rotation of the sleeve and rod. The upper end of the rod 16 is nonrotatably secured to an adjusting knob 17. With this arrangement, the knob 17 can be rotated to raise or lower the position of the abutment 6 within the cylinder and thus to vary the working volume of the measuring cylinder of the amount of liquid dispensed in a single operation of the filling machine.

The upper end of the sleeve 13 and the connecting rod 16 are enclosed within a chamber 18 for conveying gas exiting from the cylinder during filling of the cylinder with liquid and entering the cylinder during discharge of the liquid from the cylinder. The passage for gas exiting and entering the cylinder includes a nozzle or inlet 19 in the chamber 18, bores 20 formed in the sleeve 13 and extending from the inside of the chamber 18 to the longitudinal slot 21 formed in the sleeve 13 and communicating with the measuring cylinder above the float 5 and the abutment 6. A bore 39 is also formed in the abutment 6. The bore 39 is in communication with the slot 21 to allow gas to enter and exit at a point below the abutment 6. As depicted in FIGS. 1, 2, 4A and 4B, the upper and lower surfaces 22 and 23 of the float 5 are convex. As noted previously, the upper surface 22 of the float cooperates with the seal 7 and abutment 6 to act as a valve at the upper end of its travel in the cylinder. The lower end of the cylinder 4 is provided with an end plate 24 having a sealing member 25 which cooperates with the lower surface 23 of the float 5 in this embodiment so that the float also acts as a valve at the lower end of its travel in the cylinder 4. At the bottom the float 5 seals the cylinder from the passage 26 provided in the end plate 24 for ingress and egress of liquid from the measuring cylinder.

A source of liquid to be measured and dispensed by the filling machine 1 to containers 2 is provided in a supply container 27. The liquid from the supply 27 is conveyed through a valve 28 to the passage 26 and measuring cylinder 4. During the discharge stroke of the filling machine, liquid is discharged from the measuring cylinder by way of the passage 26 and a valve 29 to a container 2 to be filled. In this embodiment, the supply of liquid to be dispensed is maintained under pressure in the container 27 so that when air pressure is released above the float 5, liquid to be dispensed is conducted through the valve 28 and into the measuring cylinder until the float 5 makes sealing contact with the seal 27 and forces the same into sealing engagement with the cylinder 4 as shown in FIG. 4A. At this time a flow meter 30 senses the reduction in air flow exiting from the cylinder 4 due to the valve closing effect of seal 7 and float 5. The signal from the flow meter 30 is used to actuate a pilot valve 31 which in turn controls a power valve 32. The power valve 32 opens the line of communication from a source of filtered air represented by the arrow in FIG. 1, to the nozzle 19 and the cylinder 4 on the upper side of the float 5. The power valve also closes valve 28 and opens valve 29. The air pressure is controlled by regulators 34 and 35. In this way, during the discharge stroke, the valve 28 from the supply is closed and the valve 29 to the discharge outlet and container 2 is opened. Air pressure forces the liquid in the cylinder 4 from the cylinder by way of the passage 26 and discharge valve 29. When the float 5 reaches the bottom of the cylinder 4 the lower surface 23 of the float seats against the upper surface 25 of member 24 to effectively close the cylinder and resist further inflow of pressurized air. At this point, the flow meter 30 again detects the change in the air flow rate entering the cylinder 4. The signal from the flow meter is used to actuate the pilot valve 31 which in turn controls the power valve 32 so that the valve 29 is closed and the valve 28 opened to again supply liquid to the cylinder 4. Air exiting from the cylinder during filling thereof with liquid is released by means of a quick exit valve 36, for example.

The filling machine of the present invention can also be operated using a vacuum to pull liquid into the cylinder 4 from the supply 27. In such a case, the liquid in the supply 27 need not be pressurized aside from the provision of atmospheric pressure thereon. With such a filling mode, the vacuum is merely released above the float 5 when discharge is desired so that atmospheric pressure and gravity or air pressure empty the liquid from the cylinder 4 into the container 2.

Figure 6:
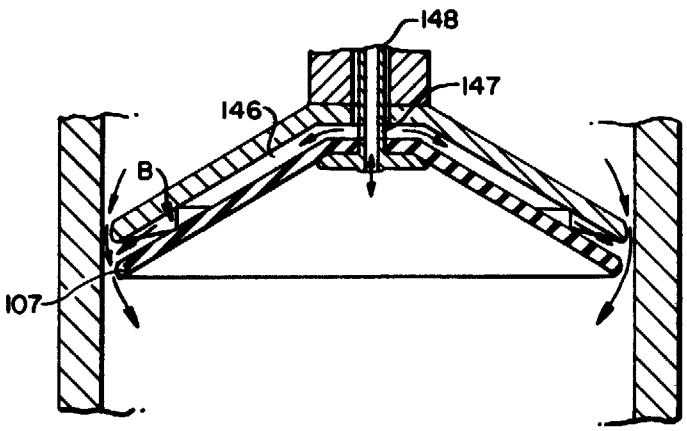
FIG. 6 is a schematic side view, partially in cross section, of the measuring chamber shown in FIG. 5 where the seal and support therefor are shown in a position for cleaning.
Figure 5:
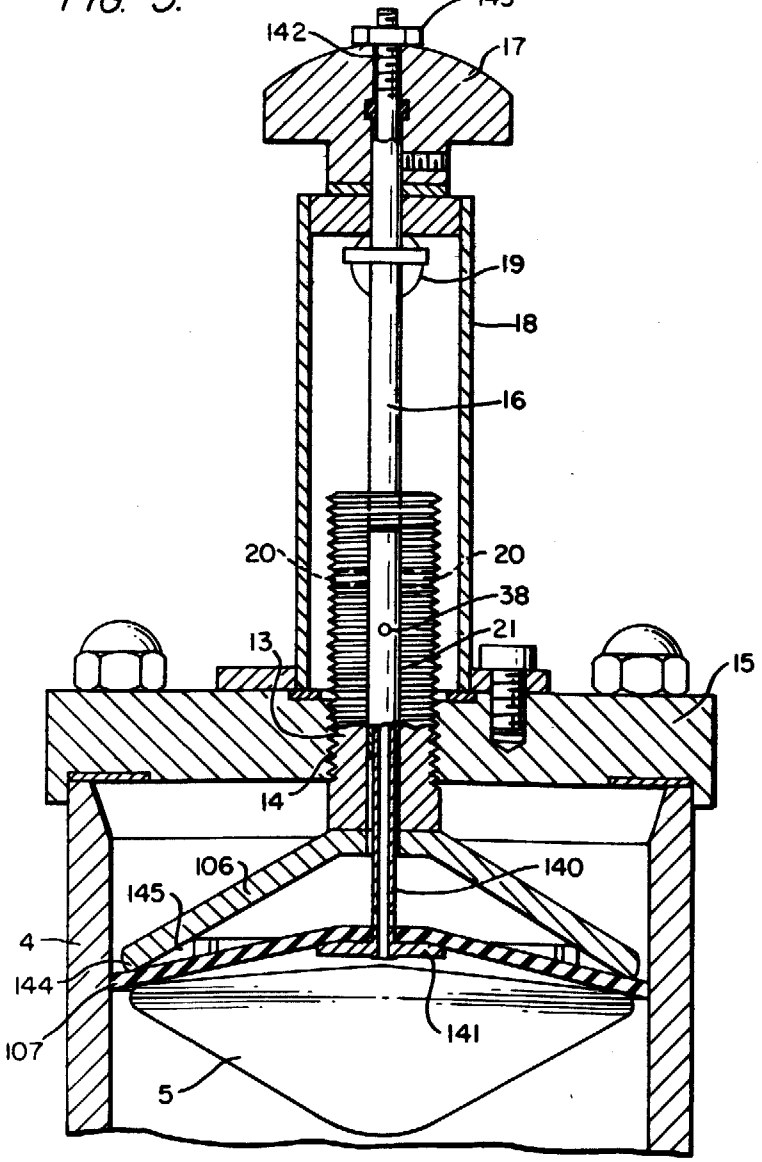
FIG. 5 is a schematic side view, partly in cross section, of a measuring chamber with an abutment, seal and adjustable support for the seal according to a second embodiment of the invention, particularly illustrating the seal in a working position.

According to a second embodiment of the invention illustrated in FIGS. 5 and 6 of the drawings, the elastomeric seal member 107 is supported adjacent the abutment 106 by means of an adjustable support 140. The support 140 is adjustable between a first, working position where the seal 107 is supported so that it is in sealing engagement with the cylinder 4 of the measuring chamber (FIG. 5), and a second position where the seal 107 is supported so that it is out of sealing engagement with the chamber as shown in FIG. 6. This last-mentioned position of the sealing member 107 is for cleaning as by steaming, for example.

The adjustable support 140 is formed by a hollow rod which extends from an area beneath the abutment 106 through the abutment, threaded sleeve 13, hollow rod 16 and adjusting knob 17. The lower end of the adjustable support 140 is flanged at 141 for supporting the seal 107 adjacent the abutment 106. The upper end of the adjustable support 140 is threaded over a predetermined length at 142. A nut 143 is provided to permit adjusting the height or position of the adjustable support between the first and second position as referred to above.

In the first position the seal 107, which has a diameter greater than that of the cylinder 4 of the measuring chamber, is positioned so that its outer edges sealingly engage the cylinder 4. In this position the adjustable support 140, which passes through a central aperture of the seal 107, is slightly higher than the outer edges of the seal 107 so as to resiliently bias the seal against the lower peripheral surface 144 of the abutment and also a plurality of spaced apart shoulders 145 which are formed on the underside of the abutment. When the adjustable support 140 is moved to its second position by turning the nut 143, the central portion of the seal 107 is raised so that the outer peripheral edge of the seal 107 moves out of sealing engagement with the measuring chamber. In particular, as shown in FIG. 6, the outer peripheral portion of the seal 107 is actually cantilevered about point B on the shoulders 145. In this way a channel 146 is formed along the upper side of the seal 107 between the seal and the abutment 106. During cleaning the cleaning substance such as steam flows through the adjustable support 140 and out the apertures 147 therein communicating with the channel 146. In this way the upper side of the seal, which is self-draining, can be cleaned. Steam enters the adjustable support 140 by means of holes therein which are in communication with the longitudinal slot 21 and bores 20 in the threaded sleeve 13.

The arrangement shown in FIGS. 5 and 6 offers the advantage as compared with that shown in FIGS. 1 through 4*b* of preventing splashing of the liquid in the measuring chamber above the seal during filling of the chamber. Such splashing is objectionable when dispensing certain types of liquids. Once the desired number of predetermined quantities of liquid has been dispensed, the seal 107 can be moved out of sealing engagement with the chamber without disassembly of the filling machine by means of the adjustable support 140 thereby facilitating cleaning of the machine.

In the form of the invention illustrated in FIG. 7 of the drawings, the float 105 acts as a valve only at the upper end of its travel since the filling machine includes a link suspension 149 extending between the float and the abutment 6 illustrated only generally. The filling machine in FIG. 7 further comprises an additional float 155 in the bottom of the chamber. The additional float 155 is configured to act as a valve at the lower end of its travel in the measuring chamber to close the lower end of the measuring chamber in cooperation with sealing member 25. The upper movement of the float 155 is limited by means of a link arrangement 156 similar to link suspension 149. In particular, each float 105 and 155 is provided with a projecting member 150 and 157, respectively, which is slidably received in a screen or perforate support 151, 158. If the seal member employed in the filling machine is of the type disclosed in FIGS. 1 through 4B, the support 151 may be directly connected to the abutment 6. On the other hand, if a seal member of the type disclosed in FIGS. 5 and 6 is employed, the support 151 may be directly connected to the lower end of the adjustable support 140 at flange 141. The use of a screen or perforated support permits air or cleaning fluid to enter and exit the measuring chamber. The support 158 may be a plurality of spaced projections which extend outwardly to cooperate with the transverse member 159 at the lower end of the projection 157 on the float 155.

The arrangement in FIG. 7 is particularly advantageous in that the central portion of the chamber of the filling machine can have many different forms, if desired, since the chamber walls do not have to guide a float during its travel from one end of the measuring chamber to the other.

A second advantage of the arrangement of FIG. 7 is that it permits the use of a measuring chamber having a removable main chamber and an upper chamber wherein the abutment is located. The main chamber is removable so that another main chamber of different volume can be used with the filling machine so as to vary the volume of liquid supplied by the filling machine.

An example of this last-mentioned form of the invention is illustrated in FIG. 8 wherein the filling machine includes a removable main chamber 160 and an upper chamber 161. The abutment 162 and float 163 are located in the upper chamber 161. The main chamber 160 is removable so that another main chamber of different volume can be used with the filling machine so as to vary the volume of liquid supplied by the filling machine. An additional float 164 is provided in a lower chamber 165 of the measuring chamber. Instead of the link mechanisms of the type disclosed in FIG. 7, the floats 163 and 164 are retained in their respective chambers by means of screens 166 and 167 extending across the measuring chamber at the junctions of the upper and lower chambers with the removable main chamber. The threaded sleeve 13, shown only generally, connected to the abutment 162 also permits adjusting the volume of the upper chamber as discussed above.

Because the seal according to the invention is angled downwardly and outwardly in its peripheral area, it is self-draining and does not collect residual liquid in use so that problems with contamination in dispensing liquids which must be of high purity are avoided. Also, because the seal may be readily moved into and out of sealing engagement with the measuring chamber, through-cleaning of the entire measuring cylinder is possible without disassembly or the need for a widened area at one end of the measuring chamber. The arrangement also permits cleaning or sterilizing operations of the entire measuring chamber, that is, both above and below the abutment without the need for disassembling the filling machine components. This is particularly advantageous in that the downtime and expense associated with such disassembly and cleaning are reduced in comparison with those systems where such disassembly or extensive special positioning of the components is required. The arrangement of the present invention thus makes it more feasible to successively dispense material of high purity from the same filling machine without fear of contamination and with a minimum of downtime for cleaning or sterilizing.

While I have shown and described several embodiments in accordance with the invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A filling machine for supplying predetermined quantities of liquid comprising measuring chamber means, float means positioned with clearance in said chamber means and adapted to move up and down in at least a portion of said chamber means with the level of liquid in said chamber means, abutment means positioned in said chamber means above said float means for limiting the upward movement of said float means in said chamber means, and seal means adjacent said abutment means for sealing against said chamber means, said seal means being arranged such that it can be moved into and out of sealing engagement with the chamber means without disassembly of the filling machine thereby facilitating cleaning of said machine.

2. A filling machine according to claim 1, wherein said seal means comprises an elastomeric member.

3. A filling machine according to claim 1, wherein said float means is configured to act as a valve at least at the upper end of its travel in said measuring chamber means such that said float means cooperates with said seal means and said abutment means to effectively close the upper end of the measuring chamber means to prevent any further increase in the level of liquid in the chamber means.

4. A filling machine according to claim 1, wherein said seal means is arranged such that at least the outer edge portion of said seal means extends downwardly and outwardly at least when the seal means is out of sealing engagement with the chamber means so that said seal means is self-draining.

5. A filling machine according to claim 1, wherein means are provided for adjusting the position of said abutment means in said measuring chamber means to vary the volume of liquid supplied by said filler machine.

6. A filling machine according to claim 1, wherein said seal means is an elastomeric member which is secured to said abutment means.

7. A filling machine according to claim 1, wherein said means limiting the downward movement of said float means includes a stop screen positioned across the chamber means beneath the float means.

8. A filling machine according to claim 1, wherein said means limiting the downward movement of said float means includes link suspension means extending between said float means and said abutment means.

9. A filling machine according to claim 1, wherein said seal means is carried by said abutment means and seals against said chamber means in response to the upward movement of said float means.

10. A filling machine according to claim 9, wherein said seal means extends downwardly and outwardly from said abutment means in at least the peripheral area of said abutment means so that the float means contacts said seal means during its upward movement in said chamber means and moves said seal means into sealing engagement with said chamber means.

11. A filling machine according to claim 1, wherein said seal means is secured at a radially inner portion thereof against a first downwardly and outwardly extending surface of said abutment means, a radially outer portion of said seal means being spaced from a second downwardly and outwardly extending surface of said abutment means, said float means contacting said radially outer portion of said seal means during its upward movement and moving said outer portion into sealing engagement with the chamber means and said second surface of said abutment means.

12. A filling machine according to claim 11, wherein said first and second surfaces of said abutment means form an obtuse angle with one another.

13. A filling machine according to claim 1, wherein an adjustable support means is provided for supporting said seal means adjacent said abutment means, said support means being adjustable between a first position where the seal means is supported so that it is in sealing engagement with the chamber means and a second position where the seal means is supported so that it is out of sealing engagement with the chamber means.

14. A filling machine according to claim 13, wherein said adjustable support means extends through a passage formed in said abutment means and to a location outside of said chamber means so that the seal means can be moved into and out of engagement with the chamber means without disassembling the filling machine.

15. A filling machine according to claim 1, wherein said abutment means includes passage means for gas to exit from said chamber means during filling of said chamber means with liquid and for gas to enter said cylinder means during discharge of liquid from said cylinder means.

16. A filling machine according to claim 15, wherein said float means is configured to act as a valve at both ends of its travel in the chamber means.

17. A filling machine according to claim 16, wherein the upper and lower surfaces of said float means are convex.

18. A filling machine according to claim 1, wherein means are provided for limiting the downward movement of said float means in said chamber means.

19. A filling machine according to claim 1 or 18, wherein said measuring chamber means includes an additional float means in the bottom of said chamber means.

20. A filling machine according to claim 1 or 18, wherein said measuring chamber means includes a removable main chamber and an upper chamber, said abutment means being located in said upper chamber and wherein said main chamber is removable so that another main chamber of different volume can be used with said filling machine so as to vary the volume of liquid supplied by the filling machine.

21. A filling machine according to claim 19, wherein said additional float means is configured to act as a valve at the lower end of its travel in said measuring chamber means to close the lower end of the measuring chamber means.

* * * * *